US009371610B2

(12) United States Patent
Testa et al.

(10) Patent No.: US 9,371,610 B2
(45) Date of Patent: Jun. 21, 2016

(54) COMPOSITION AND METHOD FOR DRY-CLEANING TEXTILE ARTICLES

(71) Applicants: ARCANE INDUSTRIES, Aubagne (FR); A.T DEVELOPPEMENTS, Fuveau (FR)

(72) Inventors: Alfred Testa, Fuveau (FR); Jean-Philippe Testa, Aubagne (FR)

(73) Assignee: ARCANE INDUSTRIES, Les Paluds, Aubagne ( * ) Notice: Subject to any disclaimer, the term of this patent is extended or adjusted under 35 U.S.C. 154(b) by 0 days.

(21) Appl. No.: 14/438,914

(22) PCT Filed: Nov. 6, 2013

(86) PCT No.: PCT/FR2013/052639

§ 371 (c)(1),
(2) Date: Apr. 28, 2015

(87) PCT Pub. No.: WO2014/076388

PCT Pub. Date: May 22, 2014

(65) Prior Publication Data

US 2015/0252519 A1 Sep. 10, 2015

(30) Foreign Application Priority Data

Nov. 6, 2012 (FR) ..... 12 02972

(51) Int. Cl.

| | |
|---|---|
| ***C11D 3/20*** | (2006.01) |
| ***C11D 3/43*** | (2006.01) |
| ***D06L 1/04*** | (2006.01) |
| ***D06L 1/08*** | (2006.01) |
| ***D06L 1/10*** | (2006.01) |
| ***D06L 1/02*** | (2006.01) |
| ***C11D 7/26*** | (2006.01) |
| ***C11D 7/50*** | (2006.01) |

(52) U.S. Cl.

CPC ..... *D06L 1/02* (2013.01); *C11D 3/2093* (2013.01); *C11D 3/43* (2013.01); *C11D 7/266* (2013.01); *C11D 7/5022* (2013.01); *D06L 1/04* (2013.01); *C11D 3/2068* (2013.01)

(58) Field of Classification Search

CPC ..... C11D 3/20; C11D 3/2068; C11D 3/2093; C11D 3/43; D06L 1/04; D06L 1/08; D06L 1/10

See application file for complete search history.

(56) References Cited

U.S. PATENT DOCUMENTS

| | | | | |
|---|---|---|---|---|
| 6,042,617 | A | 3/2000 | Berndt | |
| 6,273,919 | B1 | 8/2001 | Hayday | |
| 2003/0050214 | A1 | 3/2003 | Scheper et al. | |
| 2003/0083220 | A1 | 5/2003 | Doyel et al. | |
| 2004/0226581 | A1 | 11/2004 | Gardner et al. | |
| 2005/0209123 | A1* | 9/2005 | Laux ..... | C11D 7/5004 510/407 |
| 2012/0084928 | A1 | 4/2012 | Meyer et al. | |

* cited by examiner

*Primary Examiner* — Brian P Mruk

(74) *Attorney, Agent, or Firm* — Pearl Cohen Zedek Latzer Baratz LLP

(57) ABSTRACT

The invention concerns a composition for thy-cleaning textile articles, characterised in that it is anhydrous and in that it comprises, as an active cleaning agent: dipropylene glycol monomethyl ether, an amphiphilic solvent A chosen from the group consisting of dipropylene glycol mono-n-propyl ether, dipropylene glycol mono-n-butyl ether, dipropylene glycol mono-tert-butyl ether or the mixtures thereof, and at least one dibasic ester B having a KB index higher than 30 and represented by the following general formula (I): R—O—C(=O)—$(CH_2)$n-C(=O)—O—R' (I) in which n is a whole number between 1 and 9; R and R' are identical or different, each separately representing an alkyl group having 1 to 6 carbon atoms, or an alkenyl group having 2 to 6 carbon atoms.

13 Claims, No Drawings

COMPOSITION AND METHOD FOR DRY-CLEANING TEXTILE ARTICLES

CROSS-REFERENCE TO RELATED APPLICATIONS

This application is the National Phase Application of PCT International Application No. PCT/FR2013/052639, filed Nov. 6, 2013, which is incorporated herein by reference.

TECHNICAL FIELD OF THE INVENTION

An object of the invention is a composition for dry-cleaning textile articles.

Another object of the invention is the use of said composition as a dry-cleaning agent.

The invention also relates to a method for dry cleaning textile articles using said composition.

The technical field of the invention can, generally, be defined as that of the dry cleaning of clothing, textiles, fabrics and similar items.

STATE OF THE ART

Dry cleaning is a major industry around the world. Indeed, many types of textile articles such as clothing or others must be dry-cleaned in order to remain clean and presentable without discoloration or shrinking or wrinkling.

Dry cleaning professionals have high-performance machines wherein circulate, in a closed circuit, a cleaning solvent which makes it possible, generally, to remove contaminants such as the fats that have been deposited on the textile articles.

The most widely used solvent until now is perchloroethylene (PERC). For example, in France, 4000 dry-cleaning companies use about 8000 metric tons of PERC per year. This solvent has the advantage of being very effective for dissolving the stains and soilings (fats) that contaminate textile articles. However, the use of PERC gives rise to multiple problems, linked to the environment (destruction of the ozone layer, pollution of the ground water), human health (risk of inhaling carcinogenic substances) and to the safety of the users. Indeed, in the event of frequent and intense exposure, PERC can be toxic for the liver, the kidneys and the nervous system, and cause irritation to the eyes and the respiratory tract, as well as vertigo and nausea. PERC is subjected to substantial regulations which are increasingly aimed to suppress it. Moreover, it is already prohibited in certain regions of the world. Furthermore, as PERC has a high Kauri-Butanol (KB) index, it is a highly aggressive solvent which tends to bleed colored textile articles and to weaken the decorations that are sometimes glued therein.

Another frequent problem that arises with the use of PERC, is that the soilings extracted during dry-cleaning operations, tend to be re-deposited on the cleaned textile articles, which can accentuate the "greying" phenomenon of textiles.

Substitution solutions aimed at replacing PERC in the dry-cleaning technique have been proposed. As examples, the use of the following can be mentioned:

- aliphatic hydrocarbons (ex. White-Spirit, DF-2000® from Exxon, PureDry®, EcoSolv®, Shell Sol 140 HT®). However, despite their effectiveness in removing the fat-containing soilings from textile articles, these solvents can ignite and also have the risk of exploding. Moreover, most of these hydrocarbons are volatile organic compounds (VOC) which by evaporating are able to favor the formation of ozone. In addition, as they are highly hydrophobic, they have difficulty in dissolving water-soluble soilings.

- liquid carbon dioxide (liq. $CO_2$). The latter is inexpensive, does not have any impact on the environment and seems to represent the most effective and the most ecological solution for replacing perchloroethylene. However, the machines required to use it are very expensive and their operation has potential dangers for safety (high pressure system) and health (asphyxia);
- siloxanes such as decamethylcyclopentasiloxane which is known as GreenEarth® D5 from Dow Corning-GE. These solvents have very low volatility, have a low toxicity and make ironing easier. But, they are flammable and have a relatively low cleaning power, in particular for hydrophilic soilings. Moreover, siloxanes in particular decamethylcyclopentasiloxane is considered to be a "persistent or difficult to biodegrade substance" by the "REACH" system.
- aliphatic acetals [see US2012/0084928 A1 (Meyer and al.)]. In particular, dibutoxymethane is a solvent that was introduced on the dry-cleaning market recently. It offers a degree of effectiveness that is similar to that of PERC and is considered to be easily biodegradable. However, dibutoxymethane is a hydrophobic solvent which has difficulty in cleaning hydrophilic or polar soilings. Moreover, it is relatively expensive and its consequences on human health have not yet been studied sufficiently.
- aqueous solutions of glycol ethers [see for example patent document U.S. Pat. No. 6,273,919 (Hayday, W.A.)]. Although these aqueous solutions are presented as non-toxic, non-inflammable and biodegradables, they have produced mitigated results compared to PERC. Indeed, containing about 10% water, these solutions of glycol ethers have negative effects on certain textile articles (deformation and/or discoloration).

Moreover, the problem of the (re)contamination of the textile articles by the (re)depositing of the liquid or solid particles already extracted during dry-cleaning operations, is not resolved by any of the compositions and methods of prior art.

However, and despite the progress made recently in developing alternative solutions to the use of PERC, there is still a need for compositions and for methods that offer high performance and that are eco-responsible for the dry-cleaning of textiles.

One of the objectives of this invention is to provide a new composition that performs particularly well when it is used as a dry-cleaning solvent.

Another objective of the invention is to provide such a composition that does not pollute, respects the environment and is not dangerous for human or animal health.

The invention further has for objective to propose a composition that is adapted for eliminating both hydrophobic soilings and hydrophilic soilings contaminating the textile articles to be dry-cleaned.

The invention further has for objective to propose a composition that makes it possible to prevent the (re)contamination of the textile articles by the solid or liquid soilings already extracted during cleaning operations.

The invention also aims to achieve all of these objectives at least cost, by proposing a composition with a low cost price, comprising compounds that are inexpensive and available in commerce.

DISCLOSURE OF THE INVENTION

The solution proposed by the invention is a composition for dry-cleaning textile articles, characterized in that it is anhydrous and in that it comprises as active cleaning agent:

- dipropylene glycol monomethyl ether,
- an amphiphilic solvent A chosen from the group consisting of dipropylene glycol mono-n-propyl ether, dipropylene glycol mono-n-butyl ether, dipropylene glycol mono-tert-butyl ether or mixtures thereof, and, at least one dibasic ester B having a KB index higher than 30 and represented by the following general formula (I):

$$R—O—C(=O)—(CH_2)_n—C(=O)—O—R' \quad (I)$$

in which n is a whole number ranging between 1 and 9; R and R' are identical or different, each separately representing an alkyl group having from 1 to 6 carbon atoms or an alkenyl group having from 2 to 6 carbon atoms.

The authors of this invention, surprisingly and unexpectedly observed that the methyl ether combination of dipropylene glycol, of amphiphilic solvent A and of at least one dibasic ester B makes it possible to formulate a composition that performs particular well and that is well suited to act as a solvent or liquid for dry cleaning textiles. Without a doubt, this high performance is due to an effect of synergy.

In particular, the composition in accordance with the invention manifests a high cleaning power with respect to hydrophobic soilings (fat in particular), but also with regards to hydrophilic soilings (organic matter or water-soluble minerals) which can appear on textile articles. Indeed, the authors of this invention were able to observe that the composition of the invention is particularly effective on hydrophilic soilings, in particular on colored stains such as coffee stains, wine stains, fruit juice stains, beverage stains and bodily fluids such as blood.

Moreover, the composition of the invention also has the advantage of maintaining, in a solution or in a suspension, the liquid or solid soilings extracted during the dry cleaning operation as such preventing them from being re-deposited onto the cleaned textile articles.

Furthermore, the composition of the invention further has the advantage of being able to be prepared solely using compounds that are non-volatile, non-toxic, classified as easily biodegradable, inexpensive and available in commerce.

The composition according to the invention therefore has substantial potential.

Other preferred characteristics of the invention are listed hereinbelow, with each of these characteristics able to be considered independently or in combination with the remarkable characteristics defined hereinabove:

the quantity of dipropylene glycol monomethyl ether varies from 40% to 80% $p/p_{composition}$.

the quantity of amphiphilic solvent A varies from 5% to 40% $p/p_{composition}$.

the amphiphilic solvent A is dipropylene glycol mono-n-butyl ether.

the at least one dibasic ester B is chosen from the group comprising dimethyl succinate, dimethyl glutarate, dimethyl adipate, and mixtures thereof.

the quantity of dibasic ester B varies from 10% to 40%/$p/p_{composition}$.

the composition can further comprise a propylene glycol monoalkyl ether C chosen from the group consisting of propylene glycol monomethyl ether, propylene glycol mono-n-propyl ether, propylene glycol mono-n-butyl ether, propylene glycol mono-tert-butyl ether, propylene glycol mono-n-pentyl ether or mixtures thereof.

the composition can further comprise an additional component chosen from among antioxidants, disinfectants, perfumes and mixtures thereof.

According to another aspect, the invention also relates to the use as an active dry-cleaning agent for textile articles, a composition comprising:

dipropylene glycol monomethyl ether (DPM), an amphiphilic solvent A chosen from the group consisting of dipropylene glycol mono n-propyl ether, dipropylene glycol mono-n-butyl ether, dipropylene glycol mono-tert-butyl ether or mixtures thereof, and, at least one dibasic ester B having a KB index higher than 30 and represented by the following general formula (I):

$$R—O—C(=O)—(CH_2)_n—C(=O)—O—R' \quad (I)$$

in which n is a whole number ranging between 1 and 9; R and R' are identical or different, each separately representing an alkyl group having from 1 to 6 carbon atoms, or an alkenyl group having from 2 to 6 carbon atoms, said composition having the anhydrous form.

According to yet another aspect, this invention also relates to a method for dry cleaning textile articles, comprising the following steps:

a) soaking said articles to be cleaned by immersion in a composition in accordance with this invention, b) stirring said articles in said composition for a period of time that is sufficient to allow for dissolution and detachment of hydrophobic soilings and of hydrophilic soilings contaminating said articles, c) extracting said composition from said cleaned articles, by centrifugation d) subjecting said articles to a drying by circulation of air heated between 65° C. and 75° C.

Other purposes and advantages of this invention shall appear in the following description which is provided only for the purposes of information and which does not have for purpose to limit the scope of it.

PREFERRED EMBODIMENTS OF THE INVENTION

In this text:

"dry cleaning" means the cleaning in which the composition in accordance with the invention acts as a cleaning solvent or liquid as a replacement for water.

"textile articles" means the objects used in a personal or professional framework (e.g. various industries, hospitals, etc.), and manufactured using natural fibers such as cotton, wool, linen, silk or other, and/or using synthetic fibers such as nylon, polyamide, acrylic, polyester, acetate, viscose, or other. Examples of textile articles that can be mentioned are shirts, trousers, pullovers, vests, coats, tablecloths, covers, sheets, napkins, quilts, leather clothing, suede, etc.

"hydrophobic soilings" means the soilings contaminating textile articles and that are generally comprised of organic matter or materials that do not have any affinity for water and that are insoluble therein. Non-restricted examples of "hydrophobic soiling" include fat, oil, mayonnaise, mustard, body oils, stains of tar or motor oil, etc.

"hydrophilic soilings" means the soilings contaminating textile articles and which are mainly comprised of organic or inorganic matter that have certain affinities with water and which are fully or partially soluble therein. Non-restricted examples of "hydrophilic soilings" include body fluids such as sweat, blood, urine, food products that are soluble in water such as sugar, salt, chocolate, fruit juices, tea, coffee, etc.

"KB index": the Kauri-butanol index, which is the indirect measurement of the strength of a solvent. The KB index of a solvent corresponds to the volume of the sample in milliliters required to produce one specific degree of turbidity when it is added to 20 g of a standard solution of kauri gum (Australian copal obtained from Dammara australis) in normal butanol. The higher the KB is, the more dissolving power the solvent has. For example: dichloromethane (KB=136), trichloroethylene (KB=129) are solvents with a high dissolving power; aliphatic hydrocarbons such as Stoddard solvent (KB=33) are solvents with a low dissolving power. PERC has a KB index of 92.

The percentages, content and ratios used hereinbelow are all given with respect to the total weight of the composition "$p/p_{composition}$", unless indicated otherwise.

This invention aims firstly an anhydrous composition that is particularly suited to the dry cleaning industry. This composition is based on a combination (synergistic) of dipropylene glycol monomethyl ether (DPM), of amphiphilic solvent A and of at least one dibasic ester B. These components are used as active dry cleaning agents for textile articles.

Anhydrous means a composition that is substantially devoid of water, preferably, a composition in which water can be present at a content less than 8% $p/p_{composition}$, more preferably less than 5% $p/p_{composition}$, further preferably less than 2.5%/$p/p_{composition}$, and better yet less than 0.5% $p/p_{composition}$. This absence of water, or possibly the low content of it, provides the composition with a storage stability that is enough in order to guarantee its effectiveness over time and prevent the formation of hydrolysis products of the dibasic ester B which could reduce its cleaning effectiveness. Indeed, it is known that dibasic esters, in particular methyl esters thereof, are sensitive to the phenomena of hydrolysis in the presence of water. The absence of water, or possibly the low content of it, in the composition of the invention, is also particularly advantageous with respect to the effectiveness of the dry cleaning of textiles. Indeed, the authors of this invention were able to note that the use of a composition according to the invention in the form of an aqueous solution containing more than 8% $p/p_{composition}$ of water does not result in optimum dry cleaning.

The dipropylene glycol monomethyl ether (DPM) has for function to confer upon the composition of the invention a de-structuring and solubilizing power of the soilings, while still influencing its compatibility favorably (or miscibility) with water. This makes it possible in particular to be able to easily and quickly solubilize both hydrophobic soilings and hydrophilic soilings contaminating textile articles to be dry cleaned.

DPM is generally available in commerce in the form of a mixture of isomers with the general formula $C_7H_{16}O_3$. This is a polar organic compound with a pronounced hydrophilic nature, entirely soluble in water, biodegradable and non-toxic. It is marketed under the name DOWANOL® by the DOW® company.

The quantity of DPM used can vary within wide limits in the sense that it provides a content of at least 30% $p/p_{composition}$ of DPM. Advantageously, a quantity of DPM ranging from 40% to 80% $p/p_{composition}$ makes it possible to achieve high level of performance in dry cleaning.

The amphiphilic solvent A is chosen from the group consisting of dipropylene glycol mono-n-propyl ether, dipropylene glycol mono-n-butyl ether, dipropylene glycol mono-tert-butyl ether or the mixtures thereof.

The amphiphilic solvent A is included in the composition of the invention in order to reinforce its cleaning action, by favoring the compatibility between the DPM which is highly hydrophilic and the rest of the eminently hydrophobic composition. As the amphiphilic solvent A has a high boiling point (greater than 200° C. at 760 mmHg), it is also included in the composition in order to reduce the probability of the formation azeotropes in particular with the water and the other ingredients, for example during recycling operations by distillation.

Dipropylene glycol mono-n-propyl ether ($C_9H_{20}O_3$), dipropylene glycol mono-n-butyl ether ($C_{10}H_{22}O_3$) and, dipropylene glycol mono-tert-butyl ether ($C_{10}H_{22}O_3$) are available in commerce in the form of mixtures of isomers. In particular, dipropylene glycol n-propyl ether, dipropylene glycol mono-n-butyl ether are respectively marketed under the name DOWANOL® DPNP DOWANOL® DPNB by the DOW® company. Dipropylene glycol mono-tert-butyl ether is marketed under the name ARCOSolv® DPTB by the LyonDellBasell company.

Preferentially, the amphiphilic solvent A is dipropylene glycol mono-n-butyl ether. The authors of this invention were able to observe that textile articles cleaned using a composition of the invention of which the amphiphilic solvent A is dipropylene glycol mono-n-butyl ether, had a slight odor which is not unpleasant.

Excellent dry cleaning results were obtained when the composition in accordance with the invention comprises from 1% to 50% $p/p_{composition}$, preferably from 5% to 40% $p/p_{composition}$ amphiphilic solvent A.

Dibasic ester B (or a mixture of dibasic esters) is represented by the following general formula (I):

$$R—O—C(=O)—(CH_2)_n—C(=O)—O—R' \quad (I)$$

in which n is a whole number between 1 and 9; R and R' are identical or different, each separately representing an alkyl or alkenyl group.

The term "alkyl", in the sense of this invention, means any linear or branched alkyl group, preferably, alkyl groups containing 1 to 6 carbon atoms, in particular the following groups: methyl, ethyl, n-propyl, n-butyl, n-pentyl, n-hexyl, isopropyl, isobutyl, isopentyl, s-butyl, t-butyl, t-amyl, 1-ethyl-propyl, 1,2-dimethyl-propyl, 2,2-dimethyl-propyl, 2-methyl-pentyl, 3-methyl-pentyl, 4-methyl-pentyl, 1,1-dimethyl-butyl, 1,2-dimethyl-butyl, 1,3-dimethyl-butyl, 2,2-dimethyl-butyl, 3,3-dimethyl-butyl, 1-ethyl-butyl, 2-ethyl-butyl, 1,1,2-trimethyl-propyl, 1,2,2-trimethyl-propyl, 1-ethyl-1-methyl-propyl or 1-ethyl-2-methyl-propyl.

The term "alkenyl", in the sense of this invention, means the alkenyl groups containing preferably 2 to 6 carbon atoms, in particular the alkenyl groups chosen from among the group comprised of: 1-propenyl, 1-methyl-1-propenyl, 2-methyl-1-propenyl, 2,2-dimethyl-1-propenyl, 1-butenyl, 2-butenyl, 1-pentenyl, 2-pentenyl, 1-hexenyl, 2-hexenyl or 3-hexenyl.

The chain —$(CH_2)_n$— of the formula (I) carries, according to a preferred embodiment, at least one methyl group. The dibasic esters comprising such a chain substituted by at least one methyl group can be optical isomers and/or positional isomers.

The dibasic ester B (or a mixture of dibasic esters) is added to the other components in order to confer upon the composition of the invention the hydrophobic nature required for the solubilization and elimination of the soilings, in particular hydrophobic soilings contaminating textile articles to be dry cleaned.

Examples of dibasic ester B that can be used in the composition of the invention include dimethyl succinate, diethyl succinate, dimethyl glutarate, diethyl glutarate, dimethyl-2-methyl glutarate, dimethyl 3-methyl-glutarate, dimethyl adipate, diethyl adipate and the mixtures thereof. Advantageously, the dibasic ester B is a mixture of dimethyl succinate, of dimethyl glutarate and of dimethyl adipate.

The dibasic esters B to be used in the framework of this invention, are today available on the market. In particular, dibasic ester consisting of a mixture of dimethyl succinate (15% $p/p_{dibasic\ ester}$), of dimethyl glutarate (62% $p/p_{dibasic\ ester}$) and of dimethyl adipate (23% $p/p_{dibasic\ ester}$) is in particular marketed by the "Rhodia®" company under the name "RPDE®". This mixture of dibasic esters is also known under the acronym "DBE", and is used under this acronym (DBE) in what follows.

Dibasic esters are liquids with a high boiling point (boiling point greater than 195° C.) and high flash points (greater than 85). They have low volatility, have no or very little toxicity and are easily biodegradable.

The at least one dibasic ester B is advantageously included in the composition in accordance with this invention in a quantity ranging from 1% to 50% $p/p_{composition}$, preferably from 10% to 40% $p/p_{composition}$.

The respective proportions of the three essential ingredients, namely dipropylene glycol monomethyl ether, the amphiphilic solvent A and the dibasic ester B, were chosen in such a way that the composition of the invention offers an optimum quality of dry cleaning as well as satisfactory safety for textile articles and for colors. Moreover, the authors of this invention were able to observe that the composition of the invention can be adapted to the type of soilings (hydrophobic or hydrophilic) as well as to the type of textile articles to be dry-cleaned by varying the proportions of the three essential ingredients.

The composition can further comprise a propylene glycol monomethyl ether C chosen from the group consisting of propylene glycol monomethyl ether, propylene glycol mono-n-propyl ether, propylene glycol mono-n-butyl ether, propylene glycol mono-tert-butyl ether, propylene glycol mono-n-pentyl ether, or the mixtures thereof. The propylene glycol monomethyl ether C will be advantageously added to the other essential ingredients in order to reinforce the cleaning power of the composition according to the invention.

Examples of particularly preferred compositions include in particular anhydrous compositions comprising: (i) dipropylene glycol monomethyl ether (DPM), dipropylene glycol mono-n-butyl ether (DPnB) and dibasic ester DBE; or (ii) dipropylene glycol monomethyl ether (DPM), dipropylene glycol mono-tert-butyl ether (DPtB) and dibasic ester DBE; or (iii) dipropylene glycol monomethyl ether (DPM), dipropylene glycol mono-n-butyl ether (DPnB), dipropylene glycol mono-n-propyl ether (DPnP), and dibasic ester DBE; or (iii) dipropylene glycol monomethyl ether (DPM), dipropylene glycol mono-n-butyl ether (DPnB), propylene glycol mono-n-butyl ether (PnB), and dibasic ester DBE.

The composition according to the invention can advantageously further comprise any sort of additional components that are usually used in the field of dry cleaning. For example, the additional components can be chosen from among the antioxidants, disinfectants, perfumes and the mixtures thereof. These additional components can be present in the composition according to this invention in a quantity between 0.001% and 10% in $p/p_{composition}$ without substantially affecting its advantageous properties.

Antioxidants, when they are included in the composition of the invention, have for role to prevent or reduce or delay any formation of peroxides. Examples of antioxidants (or stabilizers) include 2,6-di-tert-butyl-p-methylphenol (BHT), 2-tertio-butyl-4-hydroxyanisole (2-BHA) and 3-tertio-butyl-4-hydroxyanisole (3-BHA) or the mixtures thereof.

Disinfectants, when they are included in the composition of the invention, have for role to allow for a disinfecting action of the textile articles to be cleaned, in particular household, medical or veterinarian laundry. They can also allow for a sanitation action of the enclosure dedicated for dry cleaning. Examples of disinfectants include quaternary ammonium salts, aldehydes, phenolic derivatives, halogenated compounds (ex. iodinated), alcohols or others.

The composition of the invention is, advantageously, in the form of a limpid and colorless liquid and can be conditioned, in anhydrous state, in any container that can receive a liquid, such as for example, a storage pot made of steel or plastic materials such as polyethylene and polypropylene.

The composition of the invention can be prepared by any method of mixing known to those skilled in the art.

During the compatibility tests with water, the authors of this invention were able to observe that the composition of the invention is able to absorb more than 40% of its weight in water. This characteristic is advantageous as it makes it possible to absorb a large portion of the water still retained in the textile articles during cleaning operations, in particular in thick textile articles (ex. coats, quilts, etc.). This results in that the composition of the invention effectively cleans a large spectrum of stains while still allowing the cleaned textile articles to retain their initial forms and tints.

The compositions in accordance with this invention are particularly suitable as a dry-cleaning solvent or fluid for textiles, and can replace PERC entirely, possibly with an adaptation of the dry cleaning machines that use PERC.

As such, this invention also has for object the use of a composition in accordance with the invention as a dry cleaning agent for textile articles.

In practice, the composition of the invention can be used at a rate of 60 liters for 18 kg to 20 kg of textile articles.

According to a specific embodiment, the dry cleaning of textile articles is carried out in the following way (or comprises the following steps):

step i): the textile articles (for example 5 to 80 kg of textile articles) to be dry cleaned are placed in a washing and drying machine provided with a cleaning and agitation basket in rotation about a horizontal axis (known to those skilled in the art), with the drum of the basket comprising a plurality of holes. The diameter of the holes can be sized by those skilled in the art, and is preferably chosen on the one hand, in such a way as to allow the active dry cleaning agent comprising a composition in accordance with the invention, to impregnate (by immersion) the textile articles to be cleaned, and on the other hand, in such a way as to allow for the extraction of the active agent of said articles cleaned during the centrifugation-extraction operation. Preferably, the plurality of holes has a diameter ranging from 0.3 to 1.3 centimeters. At the end of this step i) the textile articles are aerated by movements of rotation (alternating-reversed) of the drum, step ii): the textile articles to be cleaned are subjected to agitation (or movements of rotation (alternating-reversed)) so that the combined action of the mechanical friction of the technical articles and of the composition implemented, dissolves and detaches the hydrophobic soilings and the hydrophilic soilings. In practice, this step of agitation is carried out at a temperature ranging from 15° C. to 40° C., and lasts between 1 min and 10 min. The cleaning-agitation phase can be repeated several times, for example two times, step iii): the used composition (contaminated by the soilings eliminated from the textile articles) is extracted from the basket by pumping through a "button filter" then a filter. This filtration circuit contributes to eliminating the particles and the impurities that contaminate the used composition. Filtration can be carried out by a filtration system, for example by a filtration system chosen from the group constituted by at least one cartridge, a disc, a flexible or rigid tube and the combinations thereof. The filtration system can further include an additive chosen from the group of supports comprising absorbing carbon and diatomaceous earth. The used composition pumped in the step iii) is directed to a device allowing for the recycling of the composition of the invention (for ex. by distillation and/or dehydration).

step iv): the cleaned textile articles are subjected to a centrifugation in order to extract therefrom the greatest quantity possible of used composition. Preferably, the centrifugation operation is carried out at a speed greater than 300 rpm, preferably between 400 rpm and 500 rpm and lasts for more than 2 min, preferably between 4 to 10 minutes according to the quantity, the weight and/or the thickness of the textile articles concerned. Note that the used composition pumped in the step iii) and that extracted in the step iv) are directed to the storage tank or if they are highly contaminated, to a device that allows them to be recycled (for ex. by distillation and/or dehydration).

step v): the textile articles wrung as such are subjected to a drying—stirring operation in which a hot air current (heated to a temperature exceeding 40° C., preferably between 65° C. to 75° C.) is blown through the textile articles in order to drive the residual cleaning composition. The stirring allows for a uniform circulation of the heat on the textile articles. This drying-stirring operation can last between 30 min and 60 min according to the quantity, the weight and/or the thickness of the textile articles concerned.

step vi): the textile articles dried as such as subjected to a ventilation and to a cooling (duration between 1 min and 10 min). The temperature is lowered to less than +45° C., preferably to a temperature between 40° C. and 20° C. This is obtained via any means known to those skilled in the art.

The dry-cleaning process is terminated after cooling and removal of the textile articles from the machine.

In a preferred alternative embodiment, the method according to the invention can, prior to the placing of the textile articles in the washing and drying machine, comprise a step of brushing and/or of pre-destaining using a pre-brushing and/or pre-destaining, for the purpose of eliminating at least partially the soilings fixed on large surfaces of the textile articles. The pre-destaining can in particular be carried out using the composition according to the invention.

In another alternative embodiment, the impregnation of the textile articles by the cleaning composition can be carried out by spraying by the intermediary of nozzles.

A non-restricted embodiment shall now be given of a composition according to the invention.

Using the description that has just been given, multiple alternative embodiments of the composition and of the method of the invention can be designed by those skilled in the art without leaving the scope of the invention defined by the claims. In particular, if the composition considered performs well in the dry cleaning of various textile articles, it is not excluded to add therein other additional components known to those skilled in the art such as:

anionic or cationic surfactants or non-ionic surfactants, in order to reinforce the solubilization of water-soluble soilings such as pigments.

finishing products or retexturing products for their anti-static and/or anti-pilling properties.

other known dry-cleaning solvents, for the purpose of slightly modulating the high solvent power of the composition.

EXAMPLES

Example 1

Compositions for Dry Cleaning in Accordance with the Invention

The compositions I to V in accordance with the invention are prepared using ingredients indicated in the table hereinbelow by any method known to those skilled in the art.

| | Weight proportion ($p/p_{composition}$) in % Examples: | | | | |
|---|---|---|---|---|---|
| Ingredients | I | II | III | IV | V |
| dipropylene glycol monomethyl ether (DPM), | 64 | 70 | 70 | 58 | 58 |
| dipropylene glycol mono-n-butyl ether (DPnB) | 14 | 10 | 20 | 12 | 30 |
| dibasic ester (DBE) | 22 | 20 | 10 | 30 | 12 |

Anhydrous compositions I to V (not containing added water), limpid and colorless, are obtained, which are chemically stable. These compositions can be stored for more than 1 year, or even more than 2 years, at a temperature less than 40° C., in closed containers away from light and air. They contribute, in particular, the following properties:

compatibility with respect for the environment, human and animal health, and safety in the workplace in dry cleaning establishments, flash points: greater than 75° C., Kauri-Butanol index: greater than 70 anhydrous (non-aqueous) and can be diluted in water with a miscibility greater than 40% v/v in water.

Example 2

Effects of the Compositions I to V

The effect of the compositions I to V as dry-cleaning solvents, was studied on a panel of fabrics (10 cm×10 cm) constituted of various fibers as well as on buttons frequently encountered on textile articles (e.g. shirts). A first study concerned the observation of deformation of fabrics and the discoloring and the second study on the effectiveness of the cleaning of stains.

In order to carry out these tests, the fabrics were impregnated (by immersion) and mechanically agitated in the compositions I to V for 10 min then dried in an oven at 70° C.

Results:

a—Deformation, Discoloration and Deterioration of the Linings.

The tests carried out on different fabrics of the polyester, cotton, viscose, linen, acrylic, wool, acetate, elastane types have shown that the fabrics were well washed, dried easily and did not contain any odor after drying and correctly retained their measurement even in the case of wool (deformation less than 0.2 mm). The experiment on pieces of textile has shown that with these compositions the fabric comes out much less drier than with perchloroethylene, and procures a good slide which substantially facilitates ironing, and reduces the risk of tangling in the machines. The elastic textiles retained their extensible property. The best dry cleaning results were obtained with the compositions II and IV.

With regards to discoloration, we observed a slight bleeding in the case of the composition III without re-deposition of the latter on the other fabrics. In the case of the other compositions the resistance to discoloration is good and even better than that of perchloroethylene when the dry-cleaned fabrics are compared with the reference samples.

The tests on the trimming (buttons and accessories) have shown that the compositions I to V provide identical and even better results than perchloroethylene with a preference for the compositions I, II and V which respect these elements more.

b—Stain Removal.

The fabrics studied contained soilings caused by the following contaminants: olive oil, chocolate (Nutella®), mayonnaise, lipstick, red wine, ink and were compared with perchloroethylene. These tests were carried out without the use of a booster (surfactant).

The results of these tests showed that:

- the compositions I to V made it possible to very easily clean the fatty stains without the use of an additive.
- the composition I, II and IV are in particular highly effective for the dry cleaning of stains caused by butter or olive oil, stains which are no longer visible after the cleaning process.
- the compositions I and II were in particular highly effective for dry cleaning, in particular on the stains caused by chocolate, lipstick and wine, stains which became hardly visible at the end of the cleaning process contrary to perchloroethylene which left more substantial stains.

The invention claimed is:

1. A textile articles dry cleaning active agent consisting of a combination of the following components:

dipropylene glycol monomethyl ether, an amphiphilic solvent A chosen from the group consisting of dipropylene glycol mono-n-propyl ether, dipropylene glycol mono-n-butyl ether, dipropylene glycol mono-tert-butyl ether or mixtures thereof, and at least one dibasic ester B having a KB index higher than 30 and represented by the following general formula (I):

$$R—O—C(=O)—(CH_2)_n—C(=O)—O—R' \quad (I)$$

wherein n is a whole number ranging between 1 and 9; and R and R' are identical or different, each separately representing an alkyl group having from 1 to 6 carbon atoms or an alkenyl group having from 2 to 6 carbon atoms.

2. The active agent according to claim 1, wherein the quantity of dipropylene glycol monomethyl ether varies from 40% to 80% $p/p_{composition}$.

3. The active agent according to claim 1, wherein the amphiphilic solvent A is dipropylene glycol mono-n-butyl ether.

4. The active agent according to claim 1, wherein the quantity of amphiphilic solvent A varies from 5% to 40% $p/p_{composition}$.

5. The active agent according to claim 1, wherein at least one dibasic ester B is chosen from the group consisting of dimethyl succinate, dimethyl glutarate, dimethyl adipate, and mixtures thereof.

6. The active agent according to claim 1, wherein The quantity of dibasic ester B varies from 10% to40% $p/p_{composition}$.

7. A method for dry cleaning textile articles, comprising the following steps:

a) soaking said articles to be cleaned by immersion in the active agent of according to claim 1, b) stirring said articles in said composition for a period of time that is sufficient to allow for dissolution and detachment of hydrophobic soilings and of hydrophilic soilings contaminating said articles, c) extracting said composition from cleaned articles, by centrifugation; and d) subjecting said articles to a drying by circulation of air heated between 65° C. and 75° C.

8. The method according to claim 7, further comprising after the step (d), a step of ventilating and cooling said articles for a duration between 1 minute and 10 minutes.

9. The method according to claim 7, wherein in step (a) said articles are contained in a cleaning basket that comprises a plurality of holes having diameters ranging between 0.3 and 1.3 centimeters.

10. The method according to claim 7, wherein in step (b) said articles are stirred in said composition for a period of time ranging between 1 minute and 10 minutes.

11. The method according to claim 7, wherein during or after the step (c) the composition is filtered in order to remove the impurities that have contaminated said composition when said articles were stirred.

12. The method according to claim 7, further comprising during or after the step (c), a step consisting in recycling said composition by distillation-dehydration.

13. A composition for dry cleaning of textile articles consisting of a combination of the following components:

dipropylene glycol monomethyl ether, an amphiphilic solvent A chosen from the group consisting of dipropylene glycol mono-n-propyl ether, dipropylene glycol mono-n-butyl ether, dipropylene glycol mono-tert-butyl ether or mixtures thereof, at least one dibasic ester B having a KB index higher than 30 and represented by the following general formula (I):

$$R—O—C(=O)—(CH_2)_n—C(=O)—O—R' \quad (I)$$

wherein n is a whole number ranging between 1 and 9; and R and R' are identical or different, each separately representing an alkyl group having from 1 to 6 carbon atoms or an alkenyl group having from 2 to 6 carbon atoms, optionally a propylene glycol alkyl ether C chosen from the group consisting of propylene glycol monomethyl ether, propylene glycol mono-n-propyl ether, propylene glycol mono-n-butyl ether, propylene glycol mono-tert-butyl ether, propylene glycol mono-n-pentyl ether and mixtures thereof, and optionally an additional component chosen from antioxidants, disinfectants, perfumes, or mixtures thereof, said composition being anhydrous, water-miscible and capable of absorbing more than 40% of its weight of water.

* * * * *